US006178595B1

(12) United States Patent
Marinoni

(10) Patent No.: US 6,178,595 B1
(45) Date of Patent: Jan. 30, 2001

(54) MOUNTING FOR A DOOR LEAF

(75) Inventor: Mario Marinoni, Magenta (IT)

(73) Assignee: Societa Italiana Progetti S.R.L., Magenta (IT)

( * ) Notice: Under 35 U.S.C. 154(b), the term of this patent shall be extended for 0 days.

(21) Appl. No.: 09/091,626

(22) PCT Filed: Dec. 16, 1996

(86) PCT No.: PCT/EP96/05655

§ 371 Date: Jun. 22, 1998

§ 102(e) Date: Jun. 22, 1998

(87) PCT Pub. No.: WO97/23699

PCT Pub. Date: Jul. 3, 1997

(30) Foreign Application Priority Data

Dec. 22, 1995 (DE) ..... 295 20 472 U
Dec. 22, 1995 (DE) ..... 295 20 471 U

(51) Int. Cl.[7] ..... E05D 5/02
(52) U.S. Cl. ..... 16/252; 16/382
(58) Field of Search ..... 16/252, 382, DIG. 4, 16/71; 403/384, 386, 388, 11, 13, 14; 49/501, 339

(56) References Cited

U.S. PATENT DOCUMENTS

| | | | | |
|---|---|---|---|---|
| 3,916,596 | * | 11/1975 | Hawley | 52/758 F |
| 4,655,025 | * | 4/1987 | Marinoni | 52/771 |
| 4,689,853 | * | 9/1987 | Marinoni | 16/382 |
| 4,977,642 | * | 12/1990 | Marinoni | 16/257 |
| 5,079,798 | * | 1/1992 | Burke et al. | 16/252 |
| 5,104,271 | * | 4/1992 | Lechler | 411/166 |
| 5,497,586 | * | 3/1996 | Dodd et al. | 52/172 |
| 5,722,787 | * | 3/1998 | Mazura et al. | 403/405.1 |
| 5,867,869 | * | 2/1999 | Garrett et al. | 16/252 |

FOREIGN PATENT DOCUMENTS

| | | | | |
|---|---|---|---|---|
| 1965602 | | 12/1970 | (DE) . | |
| 26 53 559 | * | 6/1978 | (DE) | 16/382 |
| 34 25 765 A1 | * | 7/1984 | (DE) . | |
| 36 06 276 | * | 9/1987 | (DE) | 16/254 |
| 94 20 766 U | | 2/1995 | (DE) . | |
| 94 20 766 U | * | 3/1995 | (DE) . | |
| 0 035 143 | * | 9/1981 | (EP) | 16/252 |
| 0 608 063 A2 | * | 7/1994 | (EP) | 52/172 |
| 1242754 | | 1/1961 | (FR) . | |
| 2 122 031 | * | 8/1972 | (FR) . | |
| 2122031 | | 8/1972 | (FR) . | |
| 2560274 | | 8/1985 | (FR) . | |

* cited by examiner

*Primary Examiner*—Anthony Knight
*Assistant Examiner*—Robert L. Pilaud
(74) *Attorney, Agent, or Firm*—Smith, Gambrell & Russell, LLP

(57) ABSTRACT

A mounting for a door leaf, a fanlight leaf or the like, particularly for an all-glass leaf, has a plane clamping plate (1) and a plane counter clamping plate (2). The mounting can be attached, in the region of an edge recess (3) in a leaf edge (5) of the leaf, to the two opposite surfaces, and the leaf can be pinched between the clamping plate (1) and the counter clamping plate (2) by means of fastening screws (7) joining the clamping plate and the counter clamping plate. At the clamping plate (1) a web plate (9) is formed extending perpendicular to the clamping plate, which web plate, in the assembled condition, spans over the distance between the clamping plate (1) and the counter clamping plate (2) extending through the edge recess (3). The counter clamping plate is provided with a rectangular recess (17, 41) being adapted to the shape of the free end of the web plate (9), the web plate in the assembled condition engaging by means of its free end with the rectangular recess (17, 41). The clamping plate (1) inclusive of the web plate (9) and the counter clamping plate (2) are formed as extruded profile rails or rolled profile rails.

22 Claims, 9 Drawing Sheets

MOUNTING FOR A DOOR LEAF

This application is the National Stage of International Application No. PCT/EP96/05655, filed Dec. 16, 1996, which claims priority to German Application Nos. 295 20 472.9 and 295 20 471.0, both filed Dec. 22, 1995.

BACKGROUND OF THE INVENTION

The invention relates to a mounting for a door leaf, a fanlight leaf or the like, particularly for an all-glass leaf, having a plane clamping plate and a plane counter clamping plate, which, in the region of an edge recess of the leaf in a leaf edge of the leaf, can be attached to the leaf at the two opposite surfaces, and the leaf can be pinched between the clamping plate and the counter clamping plate by means of fastening screws joining the clamping plate and the counter clamping plate.

For example from the DE-OS 24 32 961 it is known a mounting for an all-glass door comprising a clamping plate and a counter clamping plate, between which the door leaf can be pinched in the region of an edge recess. At the clamping plate a lateral extension is formed, which engages in the edge recess. Moreover, the clamping plate and the counter clamping plate comprise a recess open in direction towards the edge face of the door leaf, in which recess an insert assembly is fixed having an opening for receiving a pin, for example, when the door leaf mounting is used as a bottom mounting, an essentially rectangular opening for receiving a pin of a door closing mechanism the pin being rectangular in its cross section.

On the other hand from the DE-GM 94 20 766 a door leaf mounting is known, which is formed as a casting part and which is formed with a web plate extending perpendicular to the clamping plate, at the free edge of the clamping plate. At the outer surface of the web plate a door closing mechanism bearing pin having a rectangular cross section is mounted by means of a fastening screws This door leaf mounting can also be used for door leafs, which do not comprise a recess, but only comprise bores for fastening screws extending through it, wherein the web plate embraces the door leaf edge. The clamping plates comprise parts protruding laterally from the plate plane and having bores for receiving fastening screws.

SUMMARY OF THE INVENTION

It is an object of the invention, to provide a mounting of the above mentioned type, which can be manufactured easily. Preferably the mounting according to the invention is to be adaptable to differently shaped edge recesses and is to be usable as an alternate mounting which fits for the application at all sides of the door.

The mounting according to the invention for a door leaf, a fanlight leaf or the like, particularly for an all-glass leaf, is provided with a plane clamping plate and a plane counter clamping plate, which, in the region of an edge recess of the leaf in a leaf edge of the leaf, can be attached to the leaf at the two opposite surfaces, wherein the leaf can be pinched between the clamping plate and the counter clamping plate by means of fastening screws joining the clamping plate and the counter clamping plate. At the clamping plate a web plate is formed extending perpendicular to the clamping plate, which web plate, in the assembled condition, extending through the edge recess, spans over the distance between the clamping plate and the counter clamping plate. The counter clamping plate is provided with a rectangular recess being adapted to the free end of the web plate, the web plate in the assembled condition engaging with its free end in the rectangular recess. According to the invention the clamping plate inclusive of the web plate and the counter clamping plate are formed as sections cut from extruded profile rails or rolled profile rails.

According to a preferred embodiment of the invention the web plate with its outer surface is flush to that clamping plate edge face which is adjacent to the web plate, and does not extend over said clamping plate edge face. In this case the web plate is provided with an opening defining an axis extending in a direction parallel to the plane defined by the clamping plate.

It is another preferred embodiment according to the invention, that the web plate is arranged at the clamping plate in such a way that its outer surface is misaligned to the clamping plate edge face, and that the clamping plate comprises an open fitting recess extending from the clamping plate edge face to the web plate. Into the fitting recess an insert plate is inserted, which is supported at the web plate. The insert plate is provided with an opening defining an axis extending in a direction parallel to the plane defined by the clamping plate. The insert plate can be a steel plate or a plate of a high strength aluminium based alloy or a plate of another metal or a ceramic material. According to the invention the web plate also can be provided with an opening being in alignment with the opening in the insert plate.

It is particularly advantageous that according to the invention the clamping plate inclusive of the web plate, the counter clamping plate and the insert plate are formed as an extrusion profile rail or a rolling profile rail, which do not comprise any protrusions extending laterally with respect to the extrusion or rolling direction, respectively, as, for example, bearing parts with bores for fastening screws or the like. As a result the respective plate parts can be cut off from the profile rails into sections of any appropriate length.

According to a preferred embodiment of the invention the opening in the web plate and in the insert plate, respectively, is formed as an elongated hole extending in parallel to the clamping plate. As a result, the possibility for an adjustment is provided, particularly in connection with the reception of other components, for example a bearing pin, so that the bearing pin can be inserted in such a way, that it comes exactly into engagement with an opposing receiver opening, for example with a bearing bush. It is also possible to form the opening in a circular shape and to provide thereby, for example, the possibility to insert and to press in, respectively, a circular bearing bush. Such a mounting having a bearing bush pressed in can be used for a leaf of a fixed fanlight, which is adjacent to a pivotable door leaf.

According to a preferred embodiment of the invention, if the mounting is to be provided with a pivotation pin, this pivotation pin can be provided with a widened head, which is formed in a shape corresponding to the elongated hole, so that the pivotation pin can be fitted to the elongated hole of the web plate. By means of a fastening screw and a washer plate adjacent to the inner surface of the web plate, that is the surface of the web plate which is facing the edge recess, the pivotation pin can be fixed and can be supported at the inner surface of the web plate.

According to a preferred embodiment of the invention the center of the opening in the web plate and/or in the insert plate is arranged in the center in the longitudinal direction of the clamping plate, wherein preferably the web plate or the web plate and the insert plate, respectively, inclusive of the opening is formed symmetric relative to the center in the longitudinal direction of the clamping plate. In this case the clamping plate inclusive of the web plate can be manufactured of an L-profile rail or a T-profile rail, respectively, such that in the leg of the L-profile or in the web of the T-profile, respectively, which forms the web plate, parts are removed by punching them out or cutting them off in the respective regions, particularly at the both lateral ends of the web plate. Just as well the fitting recess can be formed by punching out or cutting off material in an appropriate region of the profile part. The opening in the web plate also can be formed as a punched out opening.

According to a preferred embodiment of the invention, a longitudinal groove having an undercut is formed at a surface which is in the assembled condition the outer surface of the clamping plate and/or at a respective surface of the counter clamping plate, the longitudinal groove extending along the clamping plate and/or the counter clamping plate, respectively, and being open to its both ends. The longitudinal groove can have, for example, a dovetail shaped or a T-shaped cross section, wherein T-shaped cross section means a rectangular cross section defined by two side walls and a bottom wall, which cross section, in those sections of the side walls which are adjacent to the bottom wall, is widened laterally by additional rectangular recesses so that undercuts are formed. As a result overhanging sections are formed in the clamping plate and/or counter clamping plate, respectively. The overhanging sections have shoulders which form their edges adjacent to the additional rectangular recesses forming the, undercut sections. The longitudinal groove can, for example, serve to receive a square head of a fastening screw joining the clamping plate and the counter clamping plate and thereby to fix the fastening screw against rotation and loosening. Just as well the fastening means can be a tapped bush joined to the square head, to which a screw engages as the counter part. Also further inserts can be plugged into or inserted into the longitudinal grooves as, for example, magnet inserts for holding the cover part provided with a magnetizable magnet strip or the like. Further the T-shaped longitudinal groove can also serve for receiving a protruding bracket joint, which can be used for fixing a leaf, for example a fanlight leaf, to an adjacent building wall or the like. One of the legs of the bracket joint is inserted into the undercut longitudinal groove from one of the ends, and can be fixed by clamping it against the overhanging shoulders delimiting the longitudinal groove, the clamping being realized by means of set screws which, for example abut against the bottom wall of the longitudinal groove. The cover parts of conventional mountings are usually screwed by means of screws extending in the plane of the clamping plate after the assembly. However, for a mounting having a protruding bracket joint this is not possible at both ends. Therefore, from one end of the longitudinal groove the bracket joint having, for example, a magnet pressed in is inserted, and from the other end an insert having a magnet is inserted. For this purpose the cover part comprises, in the region of the bracket joint, a recess extending over the width of the bracket joint. The cover part, into which, for example, a magnetizable metal strip is glued, can then put on the mounting and is held by means of the magnet force. This holding force, for example, is sufficient for non pivotable fanlight panes, since these are not moved.

According to a preferred embodiment of the invention, the clamping plate and/or the counter clamping plate comprises a recess at at least one end of the longitudinal groove, and a fastening insert part is pressed into the recess and into the end of the longitudinal groove together, which fastening insert part preferably is of synthetic material, but also can be of other materials as wood or metal. A through opening extends through the fastening insert part in parallel to the plane defined by the clamping plate or to the counter clamping plate, respectively, for receiving a fastening pin or a protruding pin end extending parallel to the longitudinal direction of the longitudinal groove. According to a preferred embodiment of the invention, for example, as well a tapped bush can be screwed or pressed into the through opening, for receiving the fastening pin. Preferently the through opening is shaped elongated, so that it is realized a floating mounting for the tapped bush, the position of which in the through opening can then be changed without applying high forces. In this case, fastening insert parts made of sythetic material are particularly preferred, since these are themselves deformable.

According to a preferred embodiment of the invention, in each clamping plate and/or counter clamping plate, a fastening insert part of synthetic material without a pin is pressed into the one end of the longitudinal groove, and a fastening insert part of synthetic material having a protruding pin end is pressed into the other end of the longitudinal groove. As a cover the cover part is fixed to the clamping plate and/or the counter clamping plate, in that the protruding pin end is inserted into a respective fixing opening of the cover part. At the other end the cover part is screwed to the clamping plate or/and counter clamping plate by means of a fastening pin extending through a respective opening in the cover part and engaging with the through opening of the fastening insert part or a tapped bush inserted into the through opening of the fastening insert part, respectively, and thereby the cover part is held. In this way, for fastening the cover part it is only required one fastening screw. If the inserted tapped bushes are not exactly aligned with the center, they can be adjusted appropriately before the fastening, in consequence of their floating mounting.

According to a preferred embodiment of the invention the through opening of the fastening insert part is formed with an essentially elongated cross section, wherein the longer edges of the cross section extend essentially in parallel to the plane defined by the clamping plate. By providing a through opening of such a shape it is possible that the cover parts can be fixed even in case that the fixing openings in the cover part are not manufactured exactly. A further advantage is that the through opening in the fastening insert part has not to be manufactured having an exact fit. When fastening the cover parts the fastening pin can engage with the through opening and as a result is floating mounted. In this case it is preferred that the fastening insert part is manufactured of synthetic material, because such an insert itself is deformable and as a result the manufacturing of an inside thread in the through opening is not necessary. It is also possible, that with each clamping plate and counter clamping plate, respectively, one or both fastening insert parts of synthetic material are provided with a magnet, and the cover parts are fixed magnetically in the way already described above. Dependent on the sort of application magnets having a sufficient strength have to be used.

Further the mounting according to the invention can be easily adapted to differently shaped edge recesses, for example of a door leaf, in that an insert part being a separate component is put on the inner large surface of the web plate, which is formed adapted to the respective edge recess for the engagement therewith. In this case the mounting according to the invention is also appropriate for retrofitting already existing doors and windows. The insert part, which can have a plate shape, acts as a distance holding device between the clamping plate and the counter clamping plate, the leaf being protected by the distance holding device from too high pinching forces appearing, particularly in the region of the peripheral edge of the edge recess. Since the web plate also extends within the edge recess in the leaf, the dimensions of the insert part which is adapted to the shape of the edge recess are reduced by the depth in the edge recess to which the web plate extends. By providing the insert part as a separate component it is achieved that the insert part can be also manufactured by an extrusion pressing method.

The insert part can be directly put on the clamping plate and the counter clamping plate. However, according to a preferred embodiment of the invention it is also possible, to arrange between the clamping plate and/or the counter clamping plate on the one hand and the insert part on the other hand a distance plate which is put on the door leaf. Thereby differences of length between the inner surface of the web plate and the thickness of the leaf can be compensated.

According to a preferred embodiment of the invention, the insert part is held in position at the clamping plate or, if a distance plate is arranged between the clamping plate and the insert part, is held in position at the distance plate by means of positioning protrusions, particularly positioning pins. Such a distance plate itself can be held in position at the clamping plate by means of positioning protrusions, which are preferently formed by punching, wherein a punch is pushes against the plate from the opposite side so that it pushes through and the edges of the opening protrude from the plate. The positioning protrusions can also be formed in the shape of positioning pins.

If between the clamping plate and the insert part a distance plate of metallic material is provided, the counter clamping plate can be elastically prestressed, that is, can be curved along the longitudinal direction of the plate. This curvation can be compensated by elastically bending the counter clamping plate by fastening the fastening screws strongly, so that in consequence the pinching force from the clamping plate and the counter clamping plate to the door leaf is increased.

By the construction of the door leaf mounting according to the invention it can be relatively easily manufactured. The counter clamping plate, the clamping plate and the plate shaped insert part can all be manufactured with a high quality by an extrusion process or by hot drawing or by cold rolling, wherein the desired section parts of the profile rail can be cut off by means of simple tools, and openings can be easily formed by punching out pieces. As a result only low investment costs for the tools are required, since complicated and expensive special tools, as diecasting moulds and the like are not required.

The mounting according to the invention can be used as an alternate mounting, that is, it can be mounted to door leafs, fanlight leafs or the like from both, the right and the left side, such that the bolt heads of the fastening screws can always be oriented to the inner side of the room to which the door belongs, thereby contributing to an amelioration of the security, since, in this case, the screws cannot be loosened from outside of the room. Further the mounting can be used as a top and a bottom mounting, depending on how the opening in the web plate is formed, whether it is formed as an elongated hole for receiving a bottom closing mechanism or for receiving a pivotation pin, or whether it is formed as a round hole for receiving a bearing bush. Another application for the mounting is, for example, mounting two fanlight glasses to one another. The extrusion pressing or rolling profile rails having longitudinal grooves extending at their backside in the extrusion or rolling direction can also be used for similar mountings, for which it is, for example, required, not to form the web plate in the center in the longitudinal direction of the clamping plate, but to arrange the web plate laterally at the edge of the clamping plate.

BRIEF DESCRIPTION OF THE DRAWINGS

The invention is elucidated by means of exemplary embodiments, which, at least schematically, become obvious from the drawings. In the drawings.

DETAILED DESCRIPTION OF THE INVENTION

Figure 1:
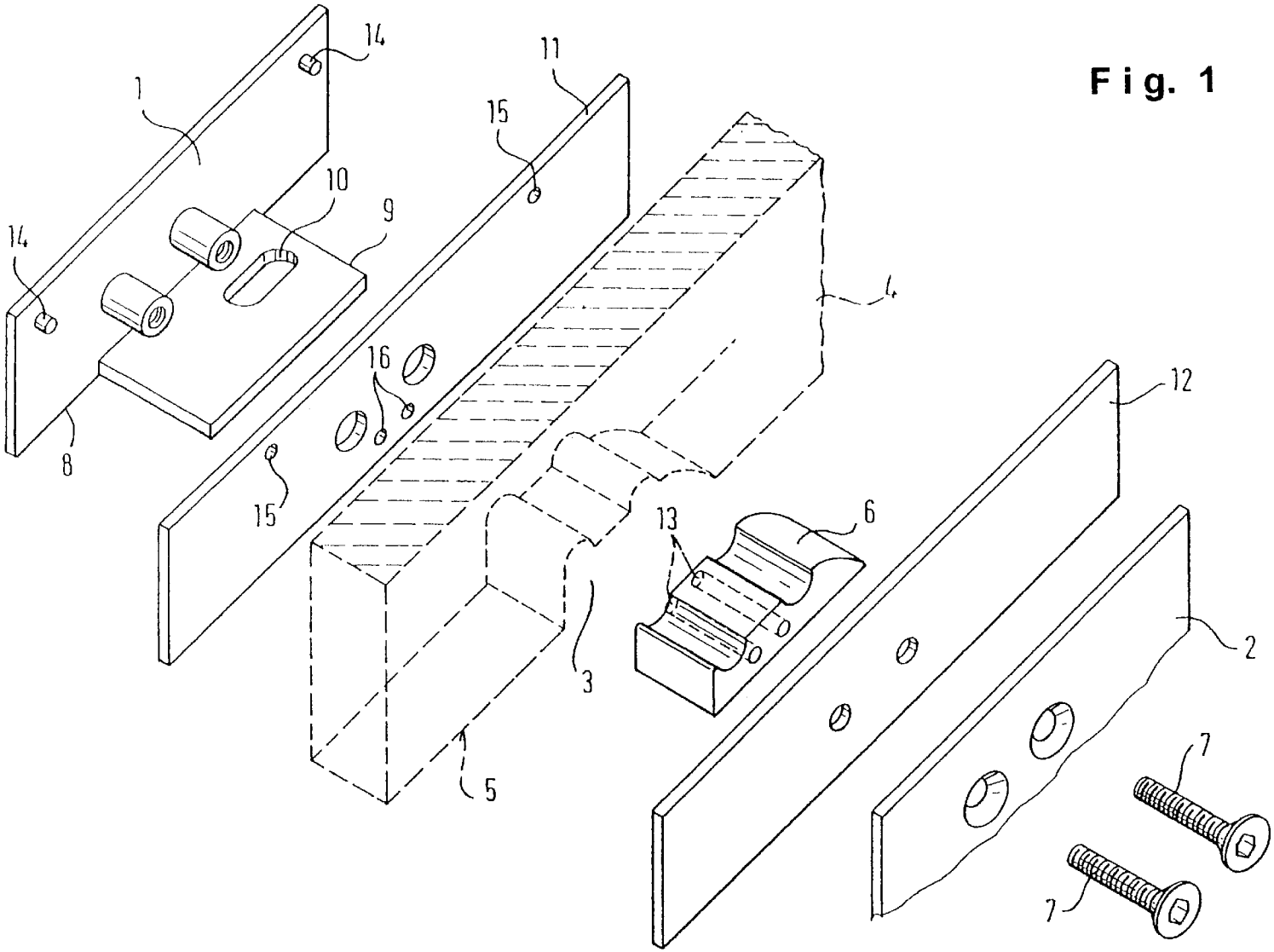
FIG. 1 is a perspective exploded view of a first embodiment of a lower mounting for a door leaf according to the invention.

The door leaf 4 shown in dashed lines in FIG. 1 comprises at its lower door leaf edge 5 an edge recess 3, in the region of which edge recess 3 the mounting according to the invention is attached to the door leaf 4. For that purpose the mounting comprises a clamping plate 1 and a counter clamping plate 2, which are fastened to each other by means of two fastening screws 7 extending through the edge recess 3, and thereby pinching the door leaf 4 between them. At the clamping plate edge 8 of the clamping plate 1 which clamping plate edge 8 is adjacent to the door leaf edge 5, is formed at the narrow edge surface side a plane web plate 9 so that the clamping plate 1 and the web plate 9 has a rectangular cross section form one piece, which web plate 9 extends in a direction perpendicular to the clamping plate 1, and extends, when the mounting is fixed, through the edge recess 3 of the door leaf 4, and overlaps the counter clamping plate 2. In the web plate 9 an essentially rectangular opening 10 is punched out which is provided for the engagement of the pin of a door closing mechanism (not shown).

At the inner large surface side of the web plate 9 is supported an insert part 6 which can be inserted into the edge recess 3 of the door leaf 4 with a low clearance with respect to the outline of the edge recess 3. Further, between each of the pairs, the clamping plate 1 and the insert part 6 and the counter clamping plate 2 and the insert part 6, respectively, it is inserted a distance plate 11, 12. The insert part 6 is held in position at the web plate 9. For the positioning of the insert part 6, in the embodiment shown in FIG. 1, positioning projections 14 in the shape of positioning pins engaging to counter bores 15 in the distance plate 11 are formed at the inner large surface side of the clamping plate 1 and positioning projections 13 in the shape of positioning pins also engaging to corresponding counter bores 16 in the distance plate are formed at that large surface side of the insert part 6 facing the distance plate 11.

Between each of the distance plates 11, 12 and the door leaf 4 additionally intermediate plates (not shown) are inserted having a recess corresponding to the edge recess 3 and being known as such, being e.g. of plastic material, rubber or paperboard, if the door leaf 4 is an all-glass door leaf.

Figure 2A:
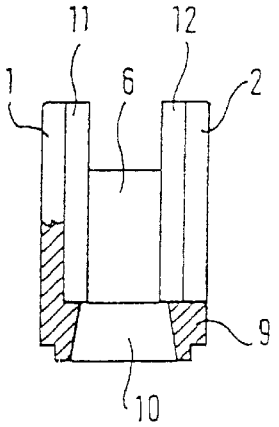
FIG. 2 shows a side view, a front view and a perspective exploded view of a second embodiment of a mounting for a door leaf according to the invention.
Figure 2B:
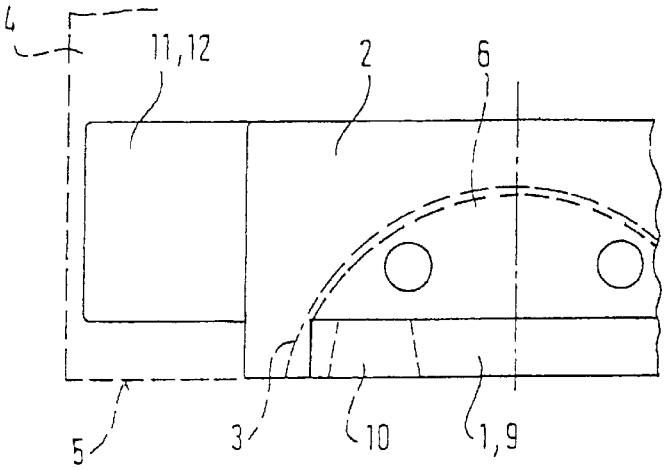
Figure 2C:
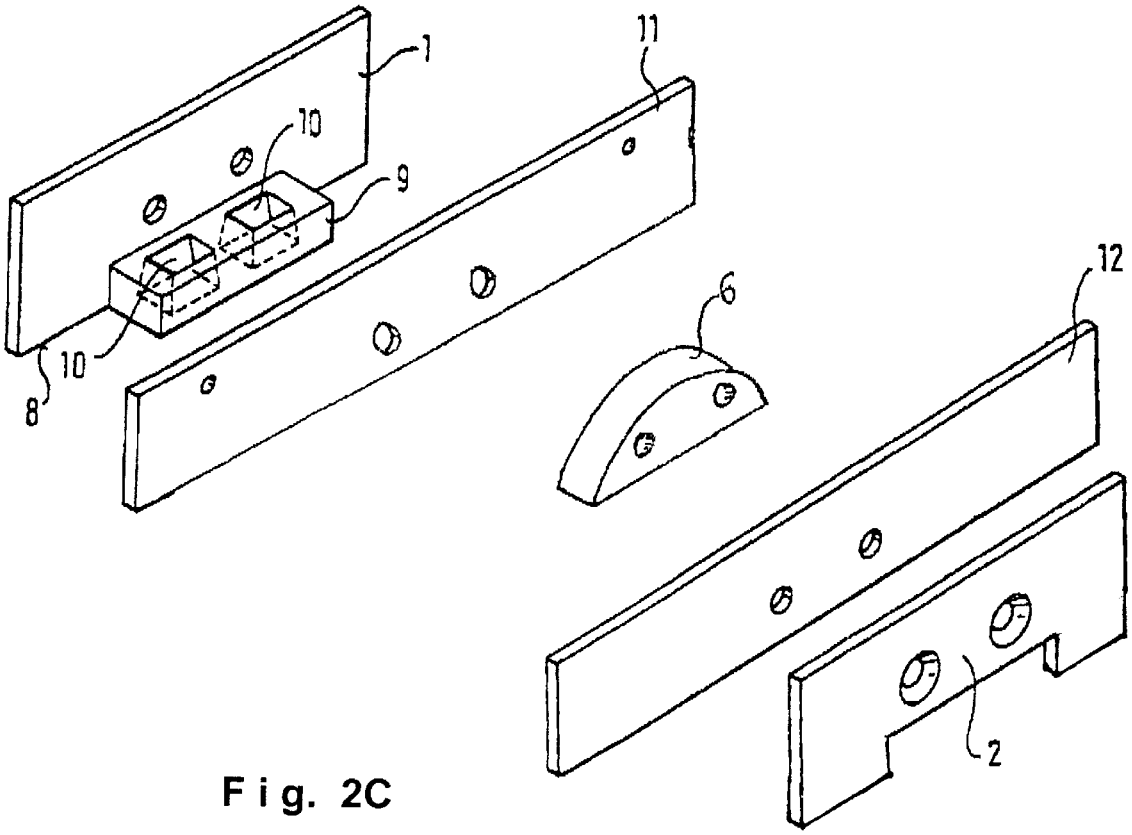
Figure 3A:
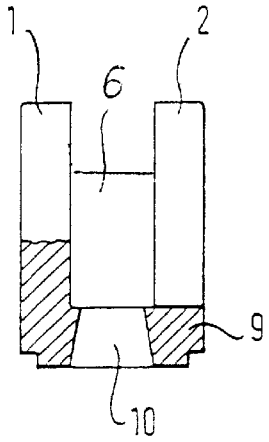
FIG. 3 shows a side view, a front view and a perspective exploded view of a third embodiment of a mounting for a door leaf according to the invention.
Figure 3B:
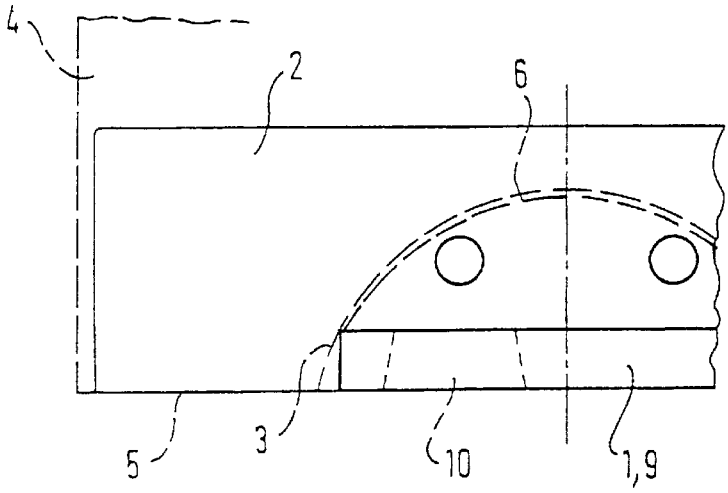
Figure 3C:
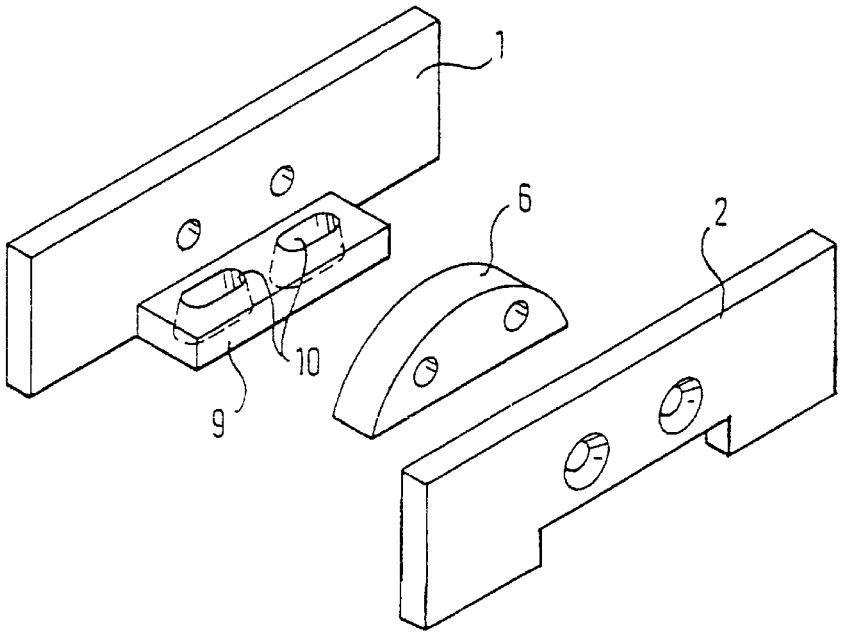

In the embodiments shown in FIGS. 2 and 3 the web plate 9 is joined to the clamping plate 1 laterally of the narrow edge surface side of the clamping plate 1, that is at the large surface side, wherein the bottom side of the web plate 9 ends flush with the clamping plate edge 8. The edge recess 3 in the door leaf edge 5 has the shape of a portion of a circle. Accordingly the plate shaped insert part 6 has the shape of a corresponding portion of a circle. In the web plate 9 two openings 10 having a rectangular cross section and the cross section of an elongated hole, respectively, are punched out, so that the web plate 9 is adapted to be used with door closing assemblies having different types of pivotation axis. The insert part 6 comprises two bores as through holes for the fastening screws (not shown), which also provide for the positioning of the insert part 6 relative to the clamping plate 1.

Figure 4A:
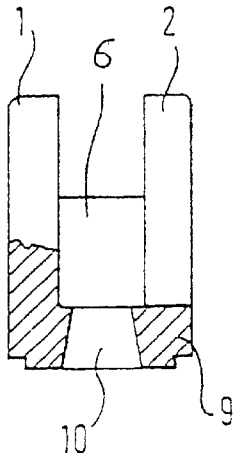
FIG. 4 shows a side view, a front view and a perspective exploded view of a fourth embodiment of a mounting for a door leaf according to the invention.
Figure 4B:
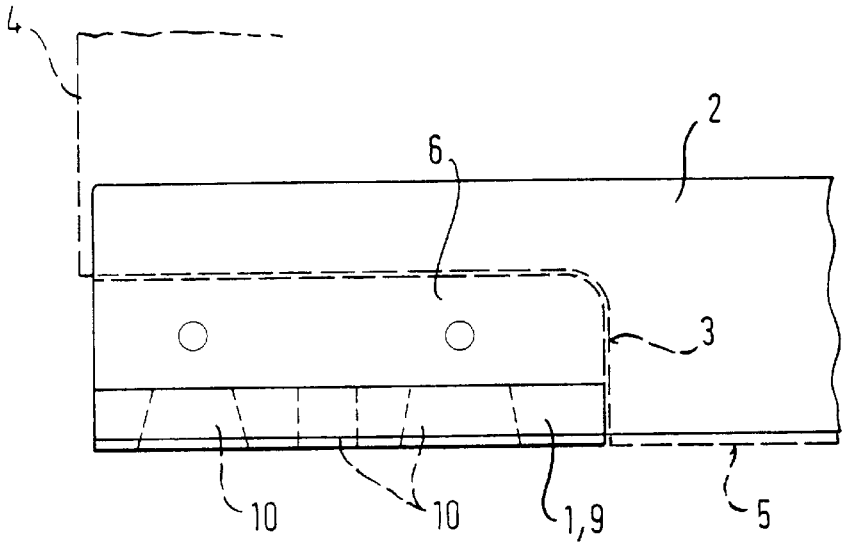
Figure 4C:
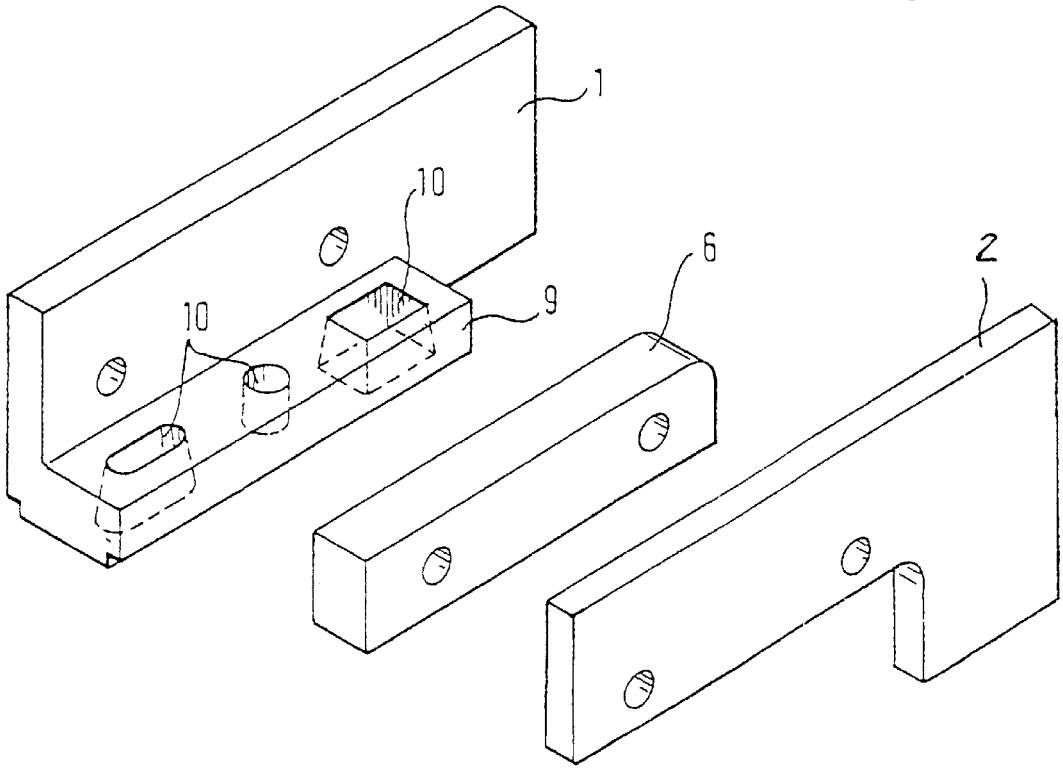
Figure 5A:
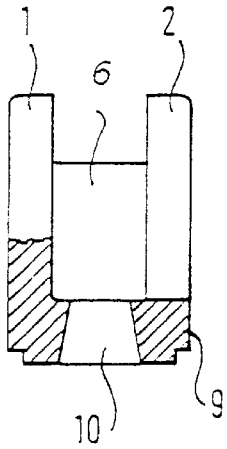
FIG. 5 shows a side view, a front view and a perspective exploded view of a fifth embodiment of a mounting for a door leaf according to the invention.
Figure 5B:
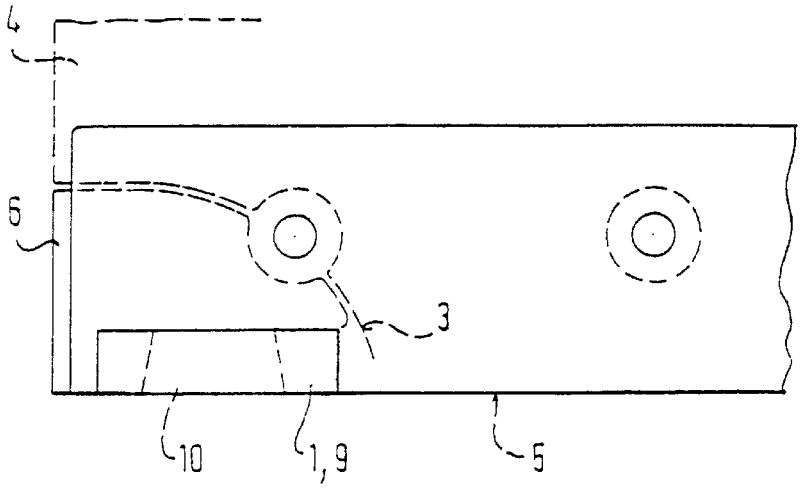
Figure 5C:
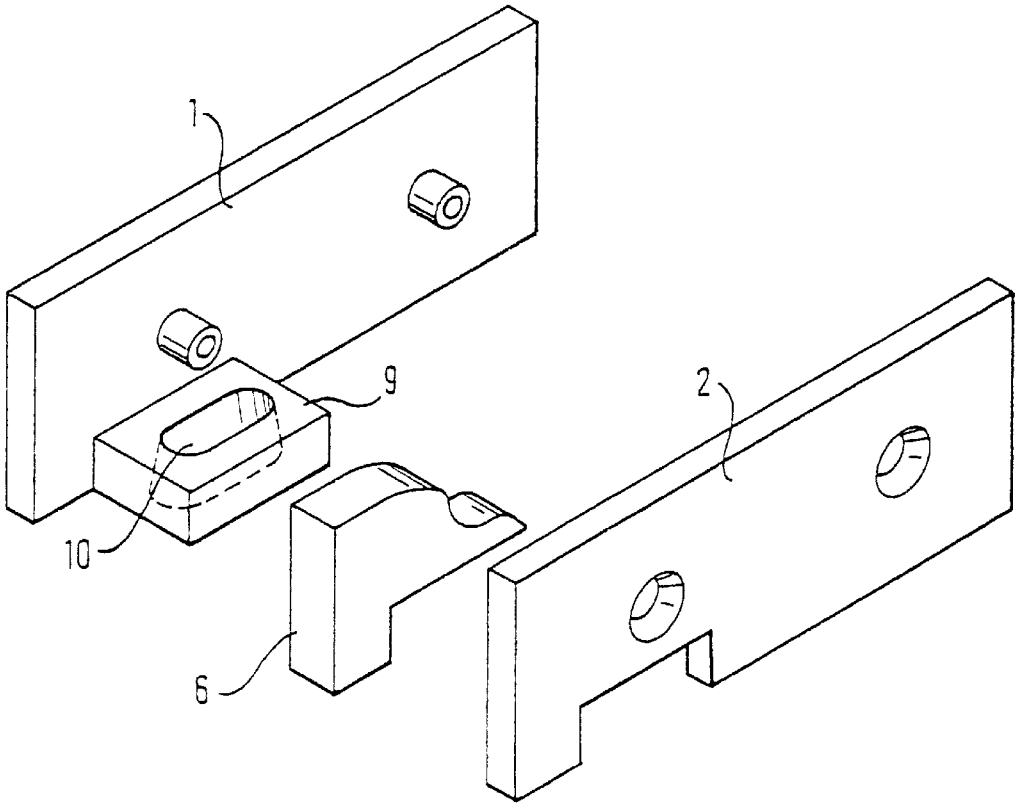

In the embodiment shown in FIG. 4 the edge recess 3 of the door leaf 4 is essentially rectangular. Accordingly the insert part 6 also has the shape of an essentially rectangular plate. The web plate 9 is provided with three differently formed openings 10 for receiving pins and bushes, respectively.

The mounting according to the invention can be faced in a usual way, wherein the cover parts are carried by the clamping plates themselves or by the distance plates.

The clamping plates 1, the counter clamping plates 2 and particularly the insert parts 6 can be manufactured by an extrusion method, by hot drawing or by profiled cold rolling. For the insert parts 6 the extrusion direction is oriented perpendicular to the plate plane of the insert part 6, which is cut off as a slice from the extruded profile bar.

Figure 6:
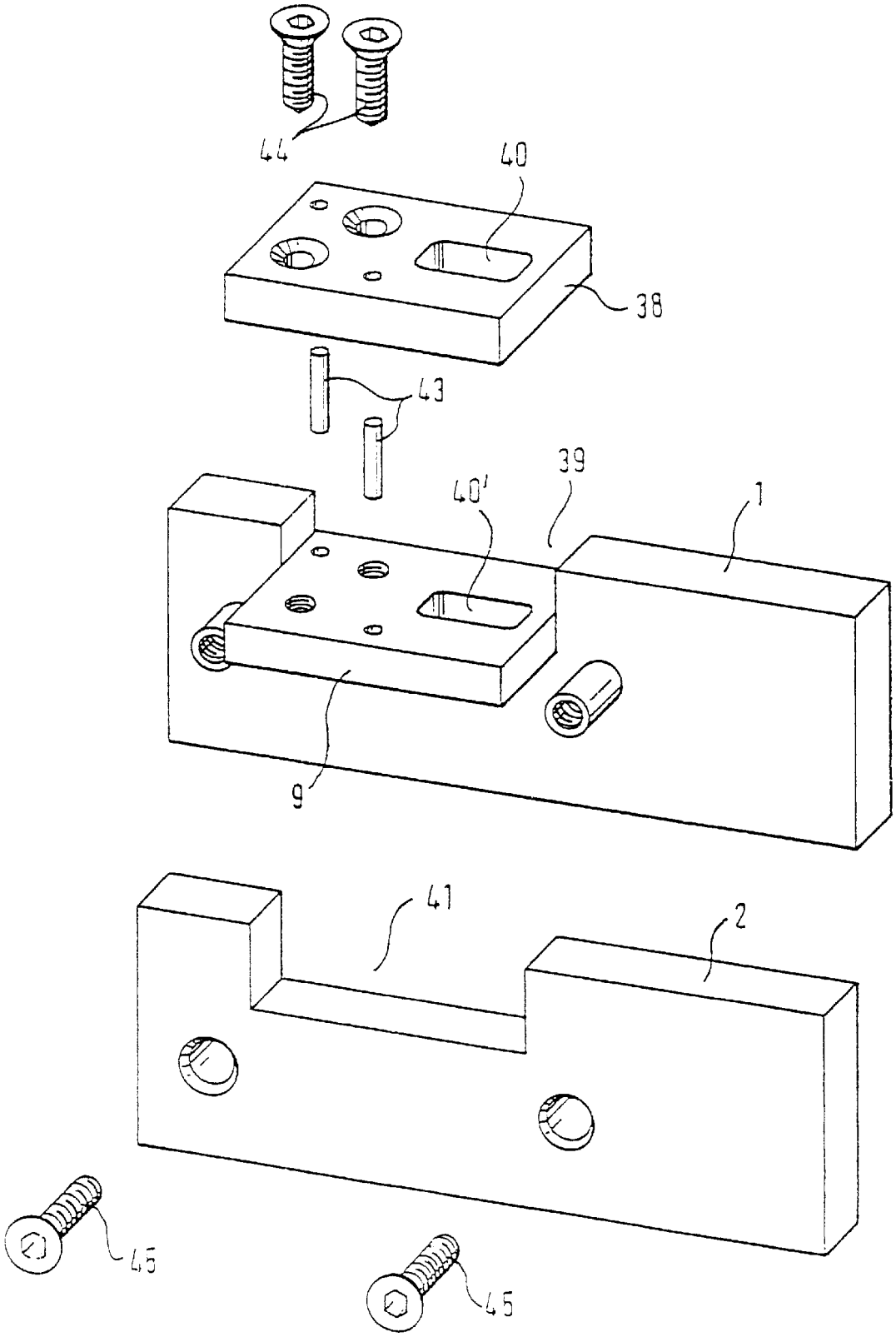
FIG. 6 shows a perspective exploded view of a sixth embodiment of a mounting for a door leaf according to the invention.

In the embodiment shown in FIG. 6 a rectangular fitting recess 39 is formed at the edge of the clamping plate 1, and the web plate 9 is formed at the clamping plate 1 such that the outer surface of the web plate 9 is positioned in the plane defined by the bottom surface of the fitting recess 39. The insert plate 38 is fitted into the fitting recess 39 and sits close to the the web plate 9 such that its narrow edge side faces are in alignment with the narrow edge side faces of the web plate 9. The insert plate 38 comprises an opening 40, which is in alignment with an opening 40' of the same size in the web plate 9, when the insert plate 38 is inserted into the fitting recess 39. The insert plate 38 is fixed in position at the web plate 9 by means of two alignment pins 43 and is fastened to the web plate 9 by means of two fastening screws 44. The counter clamping plate 2 is provided with a rectangular recess 41, to which, after screwing together the clamping plate 1 and the counter clamping plate 2 by means of fastening screws 45, the web plate 9 and the insert plate 38 supported by the web plate 9 engage, so that their narrow free end edge faces end flush with the outer large surface of the counter clamping plate 2.

In this embodiment very high forces can be transferred, for example from a pin of a door closing mechanism to the mounting, since the pin of the door closing mechanism cannot only engage with the opening 40 in the insert plate 38, but also with the opening 40' in the web plate 9 thereby having a high working depth.

Figure 7A:
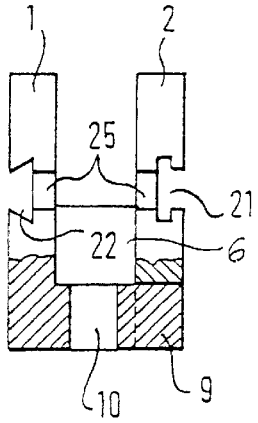
FIG. 7 shows a side view, a front view and a perspective exploded view of a seventh embodiment of a mounting for a door leaf according to the invention.
Figure 7B:
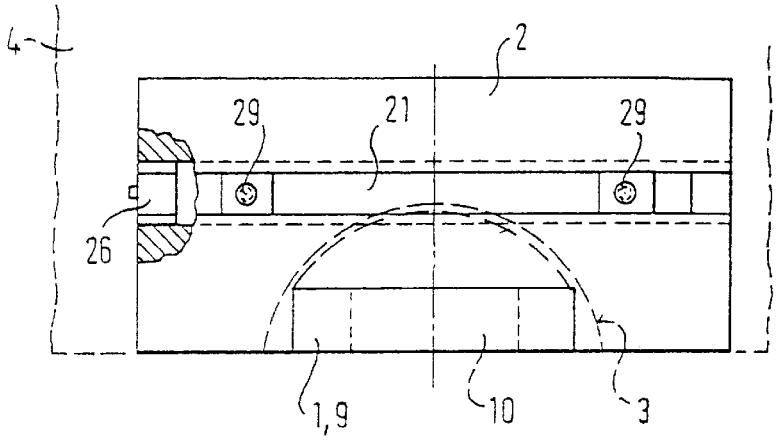
Figure 7C:
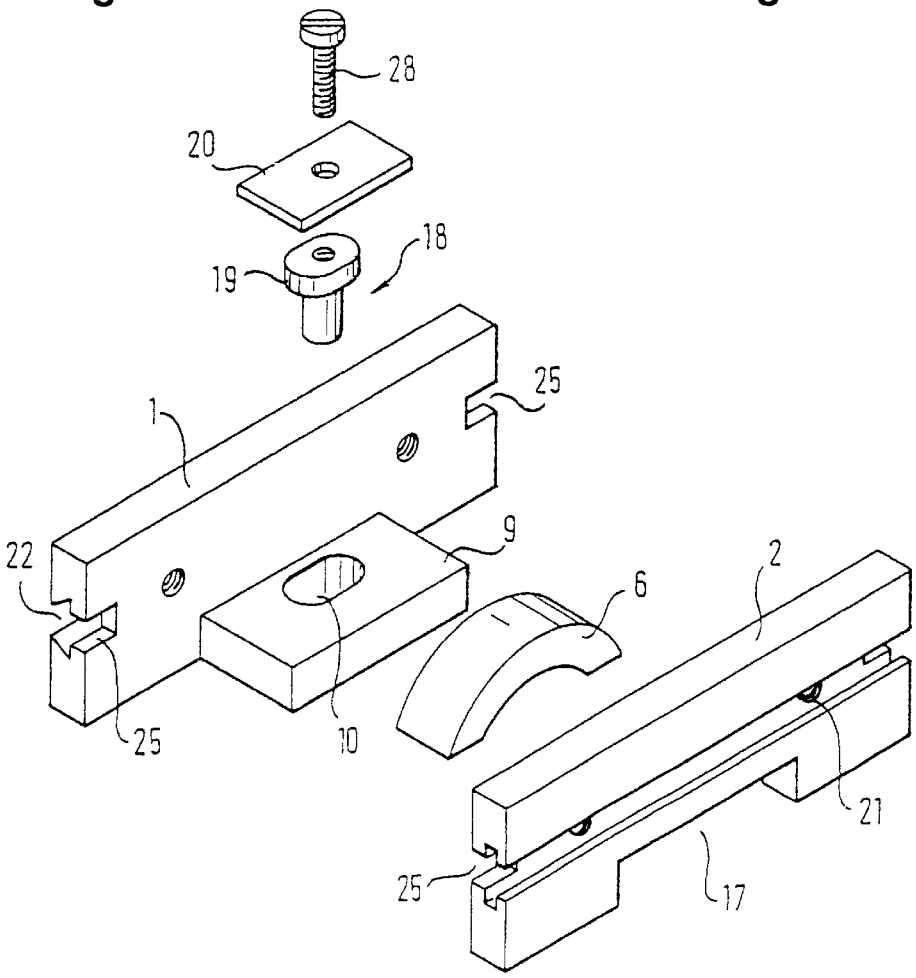

In the embodiment shown in FIG. 7 the web plate 9 is arranged in the center in the longitudinal direction of the clamping plate 1, wherein the web plate 9 with its outer large surface is flush with the narrow edge surface of the clamping plate 1. The edge recess 3 in the door leaf 4 has the shape of a portion of a circle as it is the case in FIG. 3. Accordingly the plate shaped insert part 6 is also formed in the shape of a portion of a circle. In the web plate 9 an opening 10 in the shape of an elongated hole is punched out, the web plate 9 inclusive of the opening 10 is formed symmetric with respect to the center in the longitudinal direction of the clamping plate 1. The counter clamping plate 2 comprises a rectangular recess 17 adapted to the shape of the free end of the web plate 9, the web plate 9 engaging with said rectangular recess 17 in the assembled condition, so that the narrow free end edge surface of the web plate 9 is flush with the plane defined by the outer large surface of the counter clamping plate 2.

A pivotation pin 18 can be inserted into the opening 10 in the web plate 9, which pivotation pin 18 is provided with a widened head 19 shaped corresponding to the shape of the opening 10. The pivotation pin 18 is supported at the inner large surface of the web plate 9 by means of a washer plate 20 being put on the inner large surface of the web plate 9 and by means of a fastening screw 28 inserted into the pivotation pin 18. In this case the insert part 6 is provided, in its contact surface orientated in the direction towards the web plate 9, with a recess, in which, in the assembled condition, the washer plate 20 is received with clearance, so that the insert part 6 is only supported by the web plate 9 on both sides lateral of the washer plate 20.

The clamping plate 1 and the counter clamping plate 2 each comprise a longitudinal groove 22, 21 extending in the longitudinal direction, that is the extrusion direction, the groove 22 in the clamping plate 1 being formed in the shape of a dovetail and the groove 21 in the counter clamping plate 2 having a T-shaped cross section, that is a rectangular cross section defined by two side walls and a bottom wall, which cross section, in those sections of the side walls which are adjacent to the bottom wall, is widened laterally in the shape of two additional rectangular recesses to form an undercut. The through bores in the clamping plate 1 and in the counter clamping plate 2 for the fastening screws extend in parallel to the web plate 9 and run into the longitudinal grooves 21, 22. The head of the fastening screw 29 can, for example, be a square head, which can be inserted into the groove 21 in the counter clamping plate 2 whereby the fastening screw 29 is locked against turning and loosening.

At each of both ends of the longitudinal groove 21 in the counter press plate 2, a recess 25 is provided extending from the bottom of the groove 21 through the counter press plate 2. In each end opening in the counter press plate 2 formed by an end of the longitudinal groove 21 and the adjacent recess 25 together, a fastening insert part 26 of synthetic material is pressed. One of the fastening insert parts 26 of synthetic material comprises a through opening extending in parallel to the plane defined by the counter clamping plate 2, whereas the other fastening insert part 26 of synthetic material is provided, in its through opening extending in parallel to the plane defined by the counter clamping plate 2, with a pin pressed in the through opening and having an extending end 36 extending from the fastening insert part 26 of synthetic material.

Figure 8A:
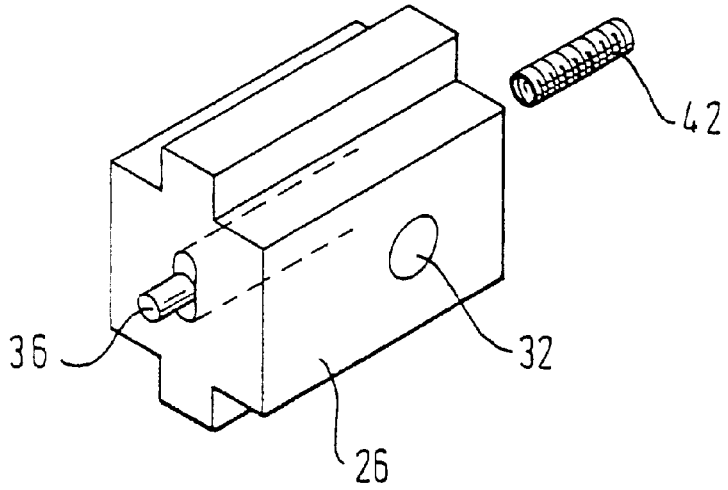
FIG. 8 shows different embodiments of the fastening insert parts, which are insertable into the longitudinal grooves shown in FIG. 7.

A fastening insert part 26 of synthetic material having an extending end 36 is pressed in the first end of the longitudinal groove 21 in the counter clamping plate 2, whereas a fastening insert part 26 of synthetic material without an extending end 36 is pressed in the other end of the longitudinal groove 21. Instead of this also a fastening insert part 26 of synthetic material having a previously pressed in tapped bush 42 can be used, as shown in FIG 8A.

Figure 9A:
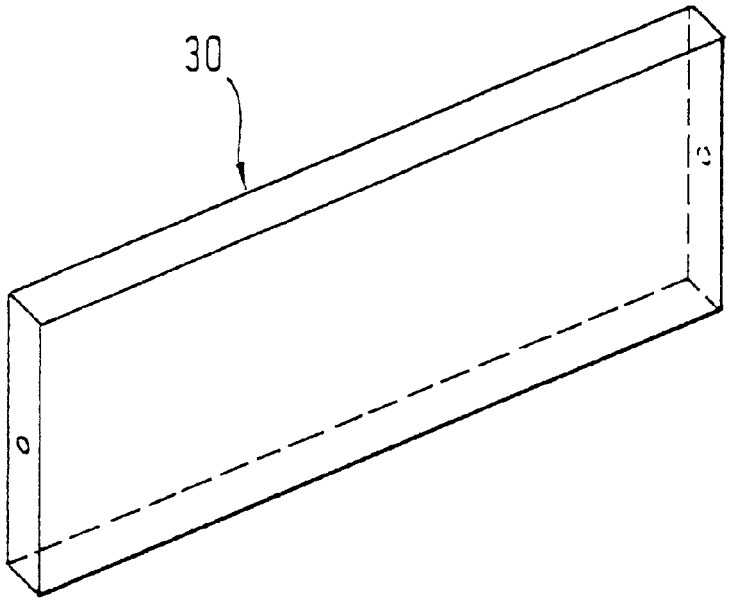
FIG. 9 shows two embodiments of the cover parts.
Figure 9B:
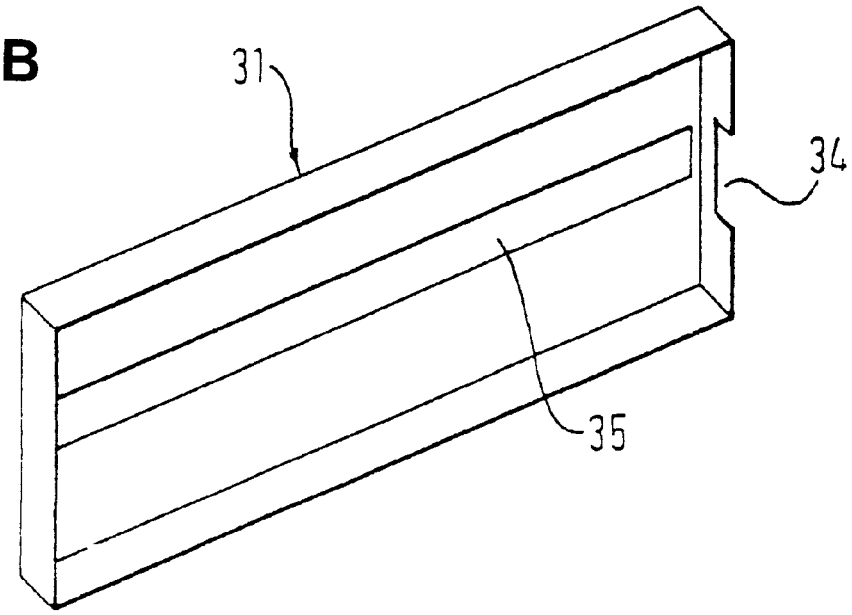

The mounting itself is covered with a cover part 30, 31 after it is mounted to the door leaf 4, as shown in FIGS. 9A and 9B. The cover part 30, 31, for example manufactured of aluminium, comprises a sheet, folded down along all edges so that it completely covers the respective clamping plate 1, 2. In one embodiment shown in FIG. 9A the cover part 30 is provided with a fastening opening at each of the folded down portions at the short edges of the cover part 30. The cover part 30 is attached with one of its fastening openings to the fastening insert part 26 of synthetic material the protruding end 36 of the fastening insert part 26 of synthetic material being inserted into the fastening opening, whereas at the opposite side a headless set screw is screwed through the fastening opening in the cover part 30 into the through bore of the fastening insert part 26 of synthetic material.

Figure 8B:
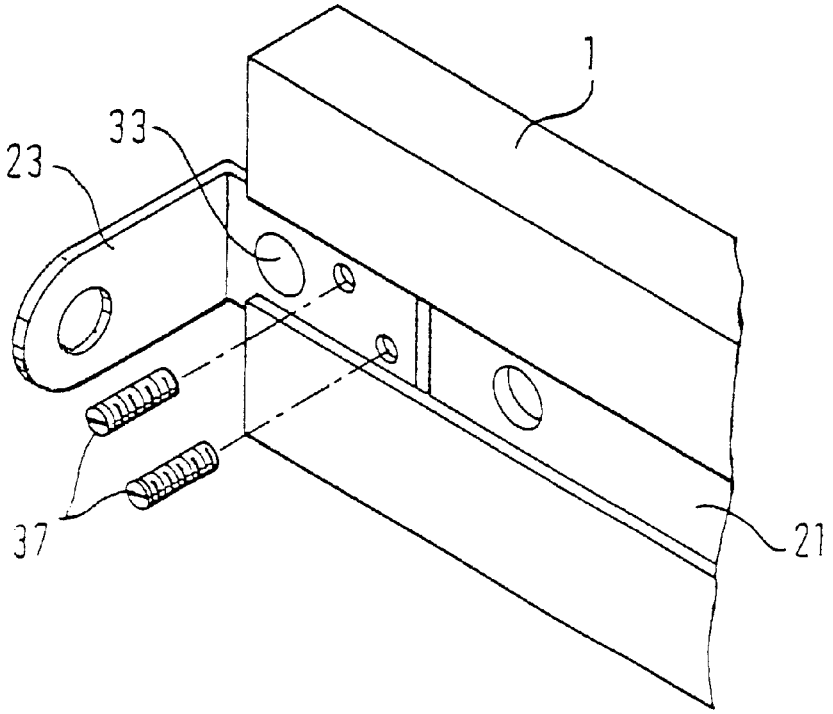

In the case, that the mounting is used for the fixed leaf of a fanlight, the above described cover part 30 cannot be used. For this purpose a protruding bracket joint 23 for fixing the mounting to, for example, a building wall, is inserted into the longitudinal groove 21 of the counter clamping plate 2, as it is shown in FIG. 8B. The bracket joint 23 has a fastening hole 24, and the bracket joint 23 can be fixed in the desired position in the longitudinal groove 21 by clamping it by means of two headless set screws 37, which extend through two threaded bores in the bracket joint 23 and abut against the bottom wall of the longitudinal groove 21. Since the cover part 31 cannot be fixed separately at that end, at which the bracket joint 23 is fixed, the fastening insert part 26 of synthetic material without protruding end 36 which is inserted into the other end of the longitudinal groove 21 can additionally be provided with a magnet 32 which is pressed in. Additionally a magnet 33 is provided in that leg of the bracket joint 23 which is inserted into the longitudinal groove 21. The cover part 31 is provided in the folded down edge at one of its smaller sides with a recess 34 corresponding to the bracket joint 23, and at the inner surface of the cover part 31 a magnetizable metal strip 35 is glued in place, so that the cover part 31 is held by the magnet force without being fixed by additional means.

What is claimed is:

1. Mounting for a door leaf, a fanlight leaf or an all-glass leaf, said leaf having two opposite surfaces, and said mounting having a plane clamping plate and a plane counter clamping plate, which, in the region of an edge recess in a leaf edge of the leaf, can be attached to the two opposite surfaces, and the leaf can be pinched between the clamping plate and the counter clamping plate by fastening screws joining the clamping plate and the counter clamping plate, wherein at the clamping plate, a plane web plate with a rectangular cross section in a direction perpendicular to the clamping plate is formed at the clamping plate and extends perpendicular to the clamping plate, such that the clamping plate and the web plate form one piece, which plane web plate, in an assembled condition, spans over the distance between the clamping plate and the counter clamping plate and extends through the edge recess, wherein the counter clamping plate is provided with a rectangular recess being adapted to the shape of a free end of the plane web plate, the free end of the plane web plate in the assembled condition engaging the rectangular recess, wherein the clamping plate, inclusive of the plane web plate and the counter clamping plate, are formed as extruded profile rails or rolled profile rails, and wherein said the mounting is adaptable to differently shaped edge recesses.

2. Mounting according to claim 1, wherein the web plate with its outer large surface ends flush with a narrow edge surface of the clamping plate which is adjacent to the web plate, and the web plate is provided with an opening defining an axis extending in a direction parallel to a plane defined by the clamping plate.

3. Mounting according to claim 2, wherein a pivotation pin is provided, which has a widened head, which is adapted to fit to the opening and is supported through a washer plate at a large surface of the web plate which is facing the edge recess.

4. Mounting according to claim 2, wherein the opening is formed as a punched out opening.

5. Mounting according to claim 1, wherein the web plate is arranged at the clamping plate so that it is misaligned to the adjacent narrow edge surface of the clamping plate, and the clamping plate comprises an open fitting recess extending from the narrow edge surface to the web plate, to which fitting recess an insert plate is inserted and is supported at the web plate, wherein the insert plate is provided with an opening defining an axis extending in a direction parallel to a plane defined by the clamping plate.

6. Mounting according to claim 5, wherein the web plate is provided with an opening which is in alignment with the opening in the insert plate.

7. Mounting according to claim 6, wherein an opening in the web plate and an opening in the insert plate are formed as elongated holes extending in parallel to the clamping plate.

8. Mounting according to claim 1, wherein in a surface which is in the assembled condition the outer large surface of the clamping plate and/or in the counter clamping plate, a longitudinal groove having an undercut and two ends is formed, the groove extending in direction of the extrusion or the rolling, respectively, and extending along the clamping plate and/or the counter clamping plate, respectively, and being open at both of its ends.

9. Mounting according to claim 8, wherein to one of the ends of the longitudinal groove a bracket joint is inserted with one of its legs, and in the protruding other leg of which bracket joint, at least one fastening hole is formed.

10. Mounting according to claim 8, wherein a magnet insert is inserted into the longitudinal groove.

11. Mounting according to claim 8, wherein the clamping plate and/or the counter clamping plate comprises a recess, at at least one end of the longitudinal groove, and into the recess and into the end of the longitudinal groove together a fastening insert part is pressed, which comprises a through opening extending parallel to the plane defined by the clamping plate or to the counter clamping plate, respectively, for receiving a fastening pin or a protruding pin end extending parallel to the longitudinal direction of the longitudinal groove.

12. Mounting according to claim 11, wherein a tapped bush is floatingly mounted in the through opening of the fastening insert part for receiving the fastening pin.

13. Mounting according to claim 1, wherein an insert part being formed as a separate component is supported at an inner large surface of the web plate, which insert part is formed adapted to the edge recess for engaging to the edge recess.

14. Mounting according to claim 13, wherein the center of the opening in the web plate and/or in the insert plate is arranged in the center in a longitudinal direction of the clamping plate.

15. Mounting according to claim 14, wherein the web plate or the web plate and the insert plate, respectively, inclusive of the opening is formed symmetric relative to the center in the longitudinal direction of the clamping plate.

16. Mounting according to claim 13, wherein between the clamping plate and/or the counter clamping plate on the one hand, and the insert part on the other hand a distance plate is arranged.

17. Mounting according to claim 13, wherein the insert part is held in position at the clamping plate.

18. Mounting according to claim 1, wherein the counter clamping plate is prestressed elastically.

19. Mounting for a door leaf, a fanlight leaf or an all-glass leaf, said leaf having two opposite surfaces, and said mounting having a plane clamping plate and a plane counter clamping plate, which, in the region of an edge recess in a leaf edge of the leaf, can be attached to the two opposite surfaces, and the leaf can be pinched between the clamping plate and the counter clamping plate by fastening screws joining the clamping plate and the counter clamping plate, wherein at the clamping plate a plane web plate with a rectangular cross-section is formed extending perpendicular to the clamping plate, which plane web plate, in an assembled condition, spans over the distance between the clamping plate and the counter clamping plate and extends through the edge recess, and wherein the counter clamping plate is provided with a rectangular recess being adapted to the shape of a free end of the plane web plate, the free end of the plane web plate in the assembled condition engaging the rectangular recess, wherein the clamping plate inclusive of the plane web plate and the counter clamping plate are formed as extruded profile rails or rolled profile rails, wherein in a surface which is in the assembled condition the outer large surface of the clamping plate and/or in the counter clamping plate, a longitudinal groove having an undercut and two ends is formed, the groove extending in direction of the extrusion or the rolling, respectively, and extending along the clamping plate and/or the counter clamping plate, respectively, and being open at both of its ends and wherein a magnet insert is inserted into the longitudinal groove.

20. Mounting for a door leaf, a fanlight leaf or an all-glass leaf, said leaf having two opposite surfaces, and said mounting having a plane clamping plate and a plane counter clamping plate, which, in the region of an edge recess in a leaf edge of the leaf, can be attached to the two opposite surfaces, and the leaf can be pinched between the clamping plate and the counter clamping plate by fastening screws joining the clamping plate and the counter clamping plate, wherein at the clamping plate a plane web plate with a rectangular cross-section is formed extending perpendicular to the clamping plate, which plane web plate, in an assembled condition, spans over the distance between the clamping plate and the counter clamping plate and extends through the edge recess, and wherein the counter clamping plate is provided with a rectangular recess being adapted to the shape of a free end of the plane web plate, the free end of the plane web plate in the assembled condition engaging the rectangular recess, wherein the clamping plate inclusive of the plane web plate and the counter clamping plate are formed as extruded profile rails or rolled profile rails, wherein in a surface which is in the assembled condition the outer large surface of the clamping plate and/or in the counter clamping plate, a longitudinal groove having an undercut and two ends is formed, the groove extending in direction of the extrusion or the rolling, respectively, and extending along the clamping plate and/or the counter clamping plate, respectively, and being open at both of its ends and wherein the clamping plate and/or the counter clamping plate comprises a recess, at least one end of the longitudinal groove, and into the recess and into the end of the longitudinal groove together a fastening insert part is pressed, which comprises a through opening extending parallel to the plane defined by the clamping plate or to the counter clamping plate, respectively, for receiving a fastening pin or a protruding pin end extending parallel to the longitudinal direction of a longitudinal groove.

21. Mounting according to claim 20, wherein a tapped bush is floatingly mounted in the through opening of the fastening insert part for receiving the fastening pin.

22. Mounting according to claim 20, wherein if a distance plate is arranged between the clamping plate and the insert part, the insert part is held in position at the distance plate by means of positioning protrusions.

* * * * *